United States Patent [19]

Caserta

[11] 4,261,479

[45] Apr. 14, 1981

[54] RELEASABLE LID CLASP FOR CANS

[76] Inventor: James Caserta, 1009 Redding Rd., Fairfield, Conn. 06430

[21] Appl. No.: 130,328

[22] Filed: Mar. 14, 1980

[51] Int. Cl.[3] ..... B65D 45/16

[52] U.S. Cl. ..... 220/326; 292/87; 292/DIG. 38

[58] Field of Search ..... 220/326, 318, 324; 229/87-89, 80, 114, DIG. 38

[56] References Cited

U.S. PATENT DOCUMENTS

| | | | |
|---|---|---|---|
| 3,104,903 | 9/1963 | Futch et al. | 292/87 |
| 3,144,166 | 8/1964 | Cross, Jr. et al. | 220/326 |
| 3,822,905 | 7/1974 | Bell | 292/87 |

*Primary Examiner*—George T. Hall

*Attorney, Agent, or Firm*—H. Gibner Lehmann; K. Gibner Lehmann

[57] ABSTRACT

A releasable lid clasp device for trash containers or cans, arranged to secure the lids thereof against accidental dislodgment. The device is constituted as an elongate body having a generally transverse groove of suitable radius which defines a pair of facing jaws that are capable of engaging opposite surfaces of the bead of the container lid. The body includes a resilient hinge which enables opening and closing movement of one of the jaws with respect to the other as the hinge flexes. In addition, there is provided a manually engageable extremity portion on the body, by which the user can flex the hinge and thereby accomplish the opening and closing movement of the one jaw. The arrangement is such that a highly satisfactory securement of the lid can be attained, without sacrificing ease of operation or reliability, especially over prolonged periods of use.

18 Claims, 12 Drawing Figures

Fig. 1
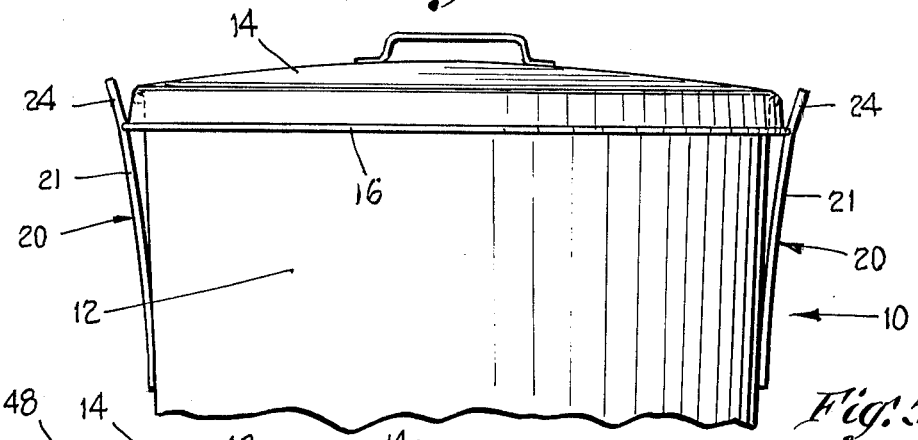
Fig. 5
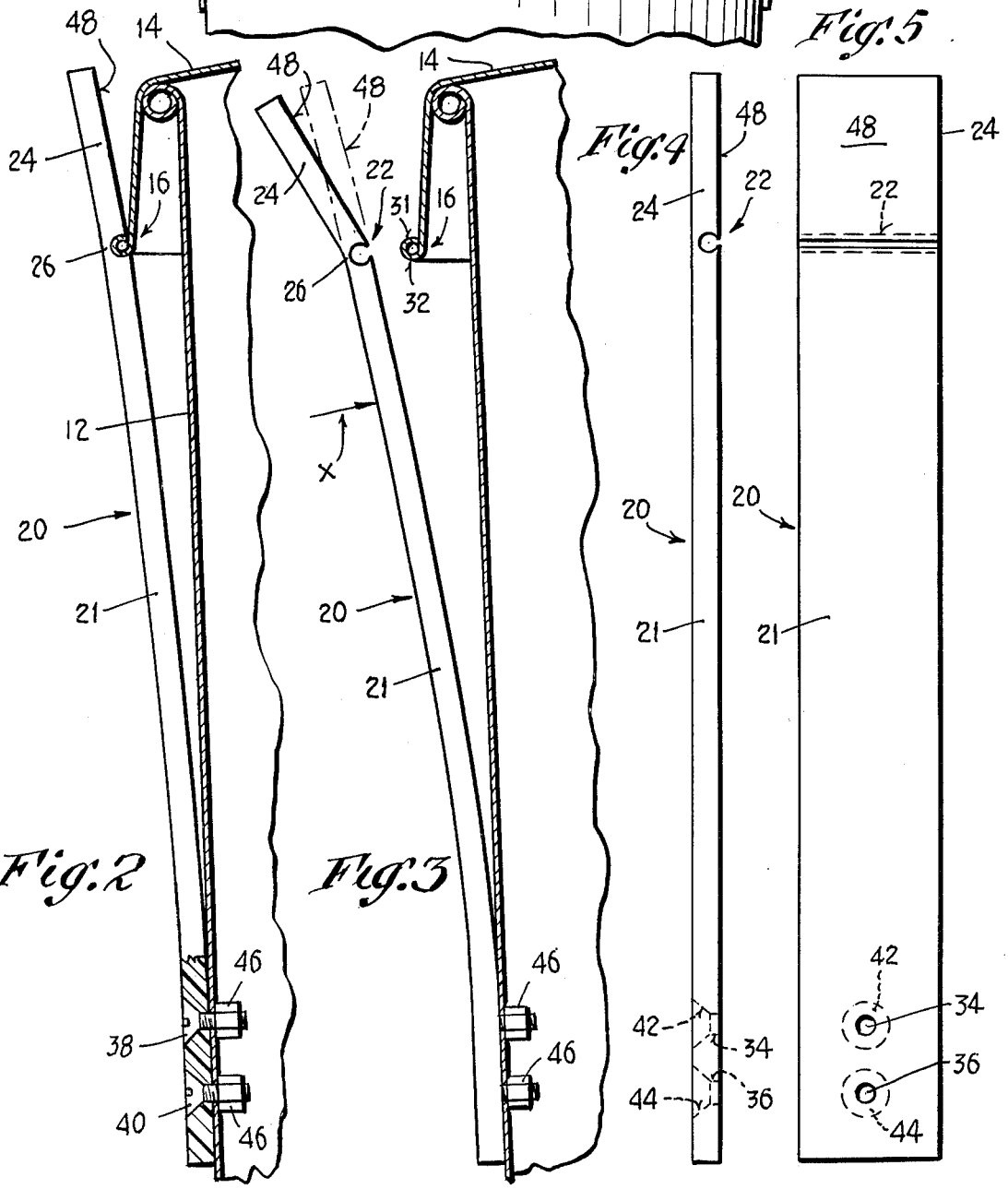
Fig. 2
Fig. 3

RELEASABLE LID CLASP FOR CANS

BACKGROUND

This invention relates generally to clasp devices for securing a removable lid to a container, and more particularly to devices of this type which are especially intended to cooperate with the bead of a metal container lid, in order to secure it against accidental dislodgment.

Prior clasp arrangements for container lids have taken a number of different forms, with various arrangements having met with greater or lesser degrees of success. Many of the lid clamping constructions that have been proposed are of the type employing swivel-type metal handles which were secured at the sides of the containers adjacent the top, and which had hook formations that were arranged to slide over the top surface of the container lid so as to hold the latter captive. These devices were usually constituted as relatively stiff wire hooks, whereas others were made as sheet metal stampings which could be quickly punched out and thereafter bent into the desired hook-like shape. Examples of the known clasp arrangements are illustrated in U.S. Pat. Nos. 2,741,398 and 3,420,399.

Still other arrangements have been proposed, involving flexible locking straps, some of which were constituted of plastic and adapted for use with plastic containers. One such flexible lock device is illustrated in U.S. Pat. No. 3,767,110.

While many of the locking arrangements heretofore known were satisfactory for the intended use, a number of disadvantages became apparent when such devices were put into use, especially over extended periods of time.

With receptacles such as trash containers, the environment in which they were used represented an important consideration, since such units were exposed to extremes of temperatures, typically from well below 0° F. to 90°-100° F., depending upon the particular climate where the item was being used. Coupled with these extremes in temperature, there also existed problems with highly corrosive atmospheres, these being in the nature of salt sprays adjacent ocean communities, sulfur-containing soot and smoke from nearby refineries, industrial complexes, and power-generating equipment, and extremes of moisture and humidity.

Many prior clasp arrangements involving metallic clamps and/or clips proved to be unsatisfactory in use, due to rapid degeneration of the metal of which they were constituted. Efforts to improve corrosion-resistance and resistance to weather have been made, by employing thin chrome, nickel or brass plating of the metal parts. Such coatings or platings did not solve the problems of corrosion, but instead reduced the rate of degeneration of the metal parts to a point where the devices could be considered by some people to have a reasonable life expectancy. However, even with plated parts, rust became a problem since the plating was often inadequate, and also due to the fact that where rubbing of the metal parts occurred, the plating rapidly wore off thereby exposing bare steel.

Other efforts to circumvent problems with metal corrosion have concentrated toward providing sturdy plastic parts. While this effectively solved the corrosion problem noted above, there has been a tendency for such plastic parts to tear and/or break after prolonged usage. This has been particularly true where the plastic part was molded into an unusual shape, and where substantial stresses were applied to opposite ends of the part, or to the pivot areas of the part.

Efforts which have been made to use either brass or stainless components of appreciable or large expanse have not met with much acceptance, due to the high cost of the raw materials involved with such parts, and with the difficulty in handling or processing of stainless steel.

SUMMARY

The above disadvantages and drawbacks of prior lid-clasp arrangements are obviated by the present invention, which has for an object the provision of a novel and improved releasable lid-clasp device for trash containers or cans, the device being especially simple in construction, reliable in operation, and easy to use.

A related object is the provision of a clasp device as above, wherein it can be readily adapted to existing cans, and installed in a minimum of time, with only simple tools being required.

Yet another object of the invention is to provide a clasp device which can be manufactured at extremely low cost, thereby minimizing the expense and adding to its appeal as far as the consumer is concerned.

Still another object is the provision of a clasp which is highly corrosion resistant, and is less likely to fail during prolonged periods of use.

Yet another object of the invention is the provision of a clasp which can be easily operated with one hand, thereby making it especially convenient to use. The user can thus easily release the clasp and lift the lid container with the one (free) hand, at such time as the other arm or hand is being used to carry a small bag or carton of trash.

A further object is the provision of a clasp which provides a highly secure retention of the container lid, thereby reducing the possibility of accidental dislodgment, resulting from overturning of the can by gusts of wind, or by neighborhood pets or wild animals.

The above objects are accomplished by a releasable lid clasp device for trash containers or cans, arranged to secure the lids thereof against accidental dislodgment, the device being constituted as an elongate body having a generally transverse groove which defines a pair of facing jaws that are capable of engaging opposite surfaces of the bead of the container lid. The body includes a resilient hinge which enables opening and closing movement of one of the jaws with respect to the other as the hinge flexes. A manually engageable extremity portion on the body enables the user to flex the hinge and thereby accomplish the opening and closing movement of the one jaw. With such a construction, a highly satisfactory securement of the lid can be attained, while still retaining reliability, and without sacrificing convenience in operation.

Other features and advantages will hereinafter appear.

In the drawings, illustrating several embodiments of the invention:

FIG. 1 is a front elevational view of a trash container employing two of the lid clasp devices of the present invention, the devices cooperating with diametrically opposed portions of the bead of the container lid.

FIG. 2 is a fragmentary section of the container and one lid clasp device, with the latter engaging the lid bead and holding the lid captive against inadvertent dislodgment.

FIG. 3 is a view like FIG. 2, except showing the lid clasp device urged outwardly so as to release the lid bead and enable the lid to be lifted off the container.

FIG. 4 is a side elevational view of the lid clasp device by itself.

FIG. 5 is a front elevational view of the clasp device.

Referring first to FIG. 1, there is shown a garbage can or trash container generally designated by the numeral 10, having an open top, a side wall 12, and a metal cover or lid 14 adapted to fit over the rim of the side wall 12, the lid 14 having a depending flange provided with a strengthened bottom rim in the form of a rolled lower edge or bead 16, of conventional construction.

Figure 6:
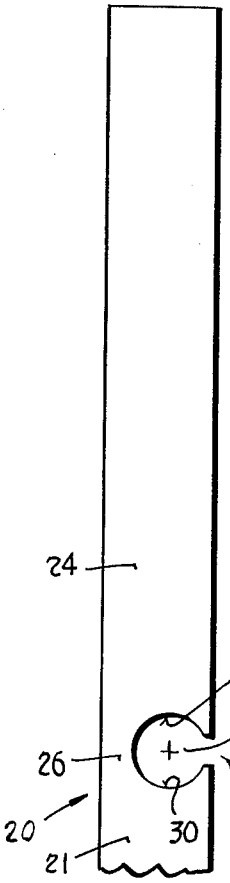
FIG. 6 is a fragmentary side elevational view of the clasp device, enlarged.

In accordance with the present invention, there is provided a novel and improved releasable lid-clasp device generally designated by the numeral 20, for clamping the lid 14 in position on the container 12, so as to secure the same against accidental dislodgment. In the embodiment illustrated in FIGS. 1–6, the clasp device comprises an arm in the form of an elongate body 21 constituted as a single integral piece, and molded of plastic substance such as nylon, or constituted of other suitable substance such as rubber, polyurethene, etc. While FIG. 1 shows two such devices being employed on opposite sides of the container, it can be readily understood that three or more similar clasps could be employed, as required to provide the desired latching capability. The body 21 is generally elongate, and has a transverse groove or channel 22 extending substantially along its entire width. At the end of the body is a manually engageable extremity portion 24, which is connected to remaining portions of the body by means of a thin web of the body material, forming a flexible and resilient spring hinge or bridge 26. The mouth of the channel 22 is seen to be narrower than other portions thereof, when the extremity portion 24 is aligned on the remaining portions of the body 21. As illustrated in FIG. 6, the groove or channel 22 is defined by a pair of oppositely facing jaws 28, 30, which are adapted to engage and cradle the opposite rounded exterior surface portions 31, 32 respectively of the lid bead 16, shown in FIG. 2. Means are provided on the body portion for enabling it to be secured to the side wall 12 of the container 10. In accomplishing this, the body is provided with countersunk mounting holes 34, 36 adapted to receive screws 38, 40, the latter preferably being of the flat-head type, and being accommodated in countersunk portions 42, 44 of the holes 34, 36 respectively. The screws 38, 40 are held in place by means of nuts 46.

Further, in accordance with the present invention the jaws 28 and 30 can be provided with undercut configurations as shown in FIG. 6, so as to provide a more positive retention of the lid bead 16 when the clasp devices are fully seated thereon as in FIG. 1. Preferably, each of the jaws 28, 30 has a concave surface configuration. With the extremity portion 24 aligned with the remainder of the body as in FIG. 6, the surfaces of the jaws 28, 30, and the hinge 26 can be constructed so as to form a substantially cylindrical, continuous surface extending through a revolution of $\frac{3}{4}$ of a circle about a center axis which is perpendicular to the plane of the paper and located at the cross lines indicated by the numeral 47. Where the lid clasp device is molded as a single bar-like piece as in FIG. 1, the groove 22 can advantageously be formed after molding, by merely drilling a small-diameter bore completely across the body of the bar. The diameter of the drill can be slightly less that the thickness of the body in order to arrive at a construction similar to that of FIG. 6, as can be readily understood. When this is done, at the same time that the jaws 28, 30 are formed, there is also formed the hinge 26. By such an arrangement, the overall manufacturing time can be reduced to an absolute minimum figure, with the corresponding cost being kept low. Alternately, a provision for the groove 22 could be incorporated directly into the mold, so that no machining operations would be required, following removal of the part from such mold.

In operation, a pair of such clasp devices 20 is preferably employed, located on opposite sides of the can 12, so that one device will engage the bead 16 on one side of the can, with a similar device being adapted to clamp the bead 16 at a point 180°around the circumference of the lid 14. The material of which the body 20 is constituted is somewhat resilient. As shown, with the lid clasp device secured to the side wall 12 by means of the screws 38, 40, the remainder of the body, particularly that in the vicinity of the hing 26, will be biased in a radially inward direction, tending to press against the bead or rim 16, and maintain the engagement of the jaws 28, 30 therewith. The rigid attachment provided by the screws 38, 40, together with the resilience of the body 20, will give rise to a bowed configuration of the body, as shown in FIG. 2, tending to maintain the seating of the bead 16 in the groove 22 in the absence of other forces applied to the clasp. Such an arrangment minimizes the likelihood of inadvertent release of the clamping devices, as might occur if the container were subject to overturning or rough handling. This feature involving the continued radially inward pressure of the arm or body 21 on the bead or rim 16 constitutes a distinct improvement over many of the devices of the prior art. As illustrated in FIG. 3, the hinge 26 permits the manually engageable extremity portion 24 to be flexed outwardly, thereby opening up the mouth of the channel formed by the jaws 28, 30, and enabling the upper portion of the body 21 to be swung outwardly a certain extent whereby the bead 16 is removed from the channel. After the body upper portion is swung outwardly, the manually engageable extremity portion 24 is then released. The resilience of the hinge 26 will cause this extremity portion 24 to assume a position more in alignment with remaining portions of the body 21, so as to close the mouth of the groove 22, thereby preventing its re-engagement with the bead 16. It can be readily see that upon release of two such clasp devices on opposite sides of the container lid 14, the latter can be readily removed from the can 12.

During re-installation of the lid, the bead 16 is employed to cam outwardly the inner surface of the extremity portion 24, this inner surface being indicated by the numeral 48, until the lid is fully seated on the can 12, as in FIG. 1. Following such seating, the manually engageable extremity portions 24 of the lid clasp devices are urged radially outwardly with respect to remaining (lower) portions thereby opening up the channels 22, and enabling the jaws 28, 30 to surround the bead 16. If desired, the user can apply a radially inward force at the location indicated by the arrow X, in FIG. 3, while maintaining the manually engageable extremity portion 24 in an angled position (solid lines in FIG. 3), so as to permit the bead 16 to be received in the channel 22. After this is done, it can be seen that upon release of the extremity portion 24, the resilience of the hinge 26 will cause the extremity portion to assume a position substantially aligned with remaining portions of the body 21, such that the bead 16 will be cradled in and held captive in the groove 22 as illustrated in FIG. 1. It can be readily understood that the dimensions of the groove 22 can be selected so as to provide a snug and positive fit with the bead 16. It has been found that for a large number of trash containers that are currently in use, the size of this bead 16 is fairly uniform, making possible the provision of a lid clasp device of one or at most several basic sizes such that virtually any size container can be accomodated.

In the appended claims, the position of the extremity portion 24 shown in FIG. 2 is referred to as a bead-retaining or first position, with respect to the remainder of the body 21, and the position of the extremity portion 24 shown in solid lines on FIG. 3 is referred to as a second, or bead-releasing position.

Figure 7:
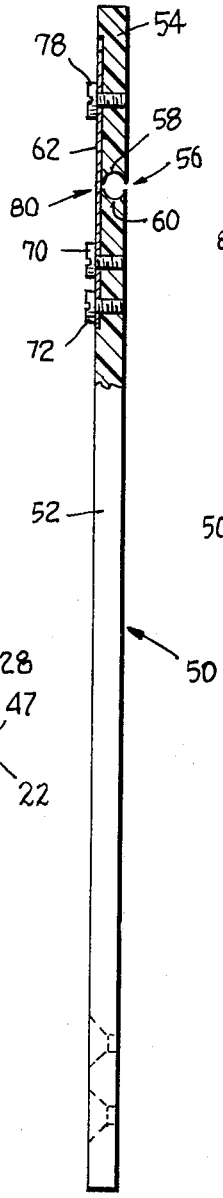
FIG. 7 is a side view, partly in section and partly in elevation, of a slightly modified lid clasp device incorporating an adjustable hinge which enables the clasp to be employed with different sized containers having somewhat larger lid bead characteristics, this constituting another embodiment of the invention.

Another embodiment of the invention is illustrated in FIGS. 7–12, showing a modified lid clasp device generally designated by the numeral 50, comprising an elongate body 52 which includes a manually engageable extremity portion 54. As in the previous embodiment, there is provided a transverse groove 56 extending for substantially the entire width of the body 52, the groove forming a channel or mouth and including oppositely facing jaws 58, 60, having undercut or concave surface configurations. As opposed to the construction of the first embodiment, in the present embodiment, the extremity portion 54 is constituted as a separate part, and is not directly connected to remaining portions of the body 52. In the appended claims, however, it is considered that the extremity portion 54 constitutes a part of the body 52. In accordance with the present invention, there is provided an adjustable hinge structure which enables limited expansion of the width of the mouth 56, so as to enable a degree of adjustment to be had, in accommodating bead formations similar to that indicated by the numeral 16 in FIG. 1, where such bead formations are of substantially increased dimensions. The hinge structure comprises a strip of spring material, which may be spring steel, phosphor bronze, or other suitable material, the strip being designated by the numeral 62, and particularly shown in FIG. 10. Preferably, the body portion 52 and the extremity portion 54 of the body portion 52 are provided with shallow, substantially flat recesses or slots 64, 66. These recesses are in alignment with one another, and are so dimensioned to receive the strip 62 so as to present a substantially flush surface at the left side of the clasp, in the manner illustrated in FIG. 7. As shown, mounting screws 70, 72 are provided, for securing the strip to the body portion 52. In addition, an elongate hole is provided in the strip 62, designated by the numeral 76, and an additional securement screw 78 extends through the slot 76, and into the manually engageable extremity portion 54. Also, as illustrated in FIG. 7, there exists a small clearance space 80 between the extremity portion 54, and other remaining parts of the body 52. With such an arrangement, it can be readily understood that the width of the channel 56 can be adjustably varied, thus increasing or decreasing the distance between the oppositely facing jaws 58, 60. Such an arrangement can be employed in the event that it is desired to use the clasp device with trash containers having container lid beads of unusually large dimension, or in situations where such beads have been somewhat flattened or otherwise distorted, possibly through mishandling or misuse. The proper position of the extremity portion with respect to remaining parts of the body 52 would, of course, have to be determined experimentally by the user, after the clasp devices are in place. When an optimum position was found, it would merely be necessary to tighten the adjustment screw 78, and thereafter the container would be ready for use.

Figure 8:
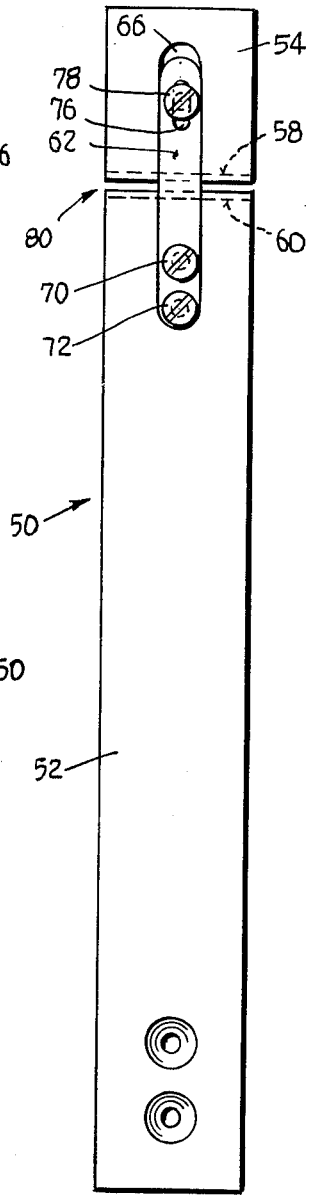
FIG. 8 is a front elevational view of the clasp device of FIG. 7.
Figure 9:
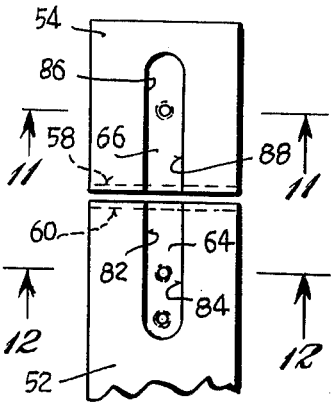
FIG. 9 is a fragmentary view of a portion of the body of the clasp device of FIG. 8, with the hinge part removed.
Figure 10:
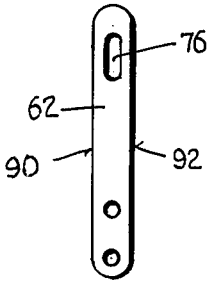
FIG. 10 is a front elevation of the hinge per se of the clasp device of FIGS. 7 and 8.
Figure 11:
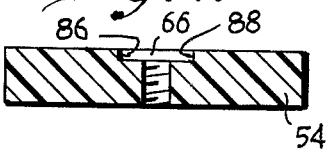
FIG. 11 is a section taken on the line 11—11 of FIG. 9.
Figure 12:
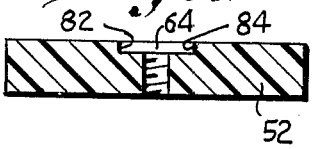
FIG. 12 is a section taken on the line 12—12 of FIG. 9.

As shown in FIGS. 9 and 11–12, the recesses 64, 66 have opposite longitudinal wall portions 82, 84 and 86, 88 respectively, which are adapted to engage and to provide a guide for the opposite longitudinal edges 90, 92 of the strip 62. By such an arrangement, there is eliminated undesirable canting or tilting of the strip 62 with respect to either of the pieces that it joins, and in addition, the tendency for the extremity portion 54 to deviate from the vertical axis of FIG. 8 is minimized. Without the relatively close fit between the edges 90, 92 and the walls 82, 84, 86, 88, shifting of the extremity portion 54 might occur.

The embodiment shown in FIGS. 7–12 would be secured to the trash container 10 in the same manner as the embodiment of FIGS. 1–6, that is, with suitable nuts and bolts. The bolts could preferably be of the flat-head type, received in countersunk holes in the lower part of the body 52 of the modified lid clasp device. In other respects, the operation and use of the clasp arrangement shown in FIGS. 7–12 is similar to that of the previous embodiment, and accordingly need not be repeated.

From the above it can be seen that I have provided a novel and improved arrangement for effecting a positive retention of trash container lids, the device being extremely simple in construction, reliable in operation, and rugged, even over extended periods of use. Due to the fact that for the embodiment of FIGS. 1–6, the clasp can be molded as a single bar-like piece, and thereafter the channel 22 and holes 34, 36 drilled, the production cost is unusually low. In addition, installation can be effected by the average person, with only conventional tools being required. These features make the device especially attractive to the consumer, for use with existing structures as a retro-fit. The device is preferably constituted entirely of corrosion-resistant material, thereby minimizing the possibility of rapid degeneration or failure due to exposure to the elements. Due to the fact that the integral hinge 26 undergoes only minor flexing, its life expectancy is relatively high. In the disclosed embodiment, it is only necessary to flex the hinge 26 on the order of 30° or so, this degree of flexing not stretching the hinge beyond its elastic limits. In the event that failure ever does occur, it is a simple matter to replace the worn or broken device with a new unit, merely by loosening the screws 38, 40, removing the unit, and substituting a new one. Accordingly, great flexibility is realized.

Due to the resilience of the hinge 26, a positive retention of the bead 16 is made possible. The direction of the force of the bead 16 on the clasp device is almost in line with the axis of the body. Thus, while there is a slight tendency for the bead to cam the manually engageable extremity portion 24 in a counterclockwise direction in FIG. 2, in the event that the can is overturned and the lid is being forced off, most of the pressure is applied along a line substantially parallel to this body axis, as a result, it has been found that the present clasp devices can withstand substantial force and abuse, even in the event that the trash containers are subjected to tipping or other rough handling. Also, the present arrangement has been found to be very effective from the standpoint of preventing wild animals or neighborhood pets from gaining access to the container, thus effectively solving the problem of cleaning up trash which has been strewn over the lawn or driveway area of a residential home. The devices of the present invention are thus seen to represent a distinct advance and improvement in the technology of clasp arrangements for container lids.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

I claim:

1. A releasable clasp device for trash containers, arranged for engagement with the bead of the container lid to secure the latter against accidental dislodgement, comprising in combination:

(a) an elongate body constituted of a substance, selected from the group consisting of plastic, rubber, vinyl, and polyurethane, (b) said body having a transverse groove forming a pair of facing jaws adapted to engage opposite surfaces of the bead, and (c) resilient means on the body, providing a spring hinge to enable opening and closing movement of one of said jaws with respect to the other as the hinge flexes, (d) said body having a manually engageable extremity portion for effecting flexing movement of said hinge to accomplish the opening and closing movement of said one jaw.

2. The invention as defined in claim 1, wherein:

(a) said hinge and extremity portion are integral with the remaining parts of the body.

3. The invention as defined in claim 1, wherein:

(a) said hinge is constituted as a thin web of the body material, joining the extremity portion to other parts of the body.

4. The invention as defined in claim 1, wherein:

(a) said one jaw is integral with the body extremity portion, (b) said hinge comprising a thin web of body material disposed immediately adjacent to said jaws.

5. The invention as defined in claim 1, wherein:

(a) one of said jaws has a concave surface configuration.

6. The invention as defined in claim 1, wherein:

(a) both of said jaws have concave surface configurations.

7. The invention as defined in claim 1 wherein:

(a) said jaws are integral with one another and with said hinge, (b) said jaws and hinge forming a substantially cylindrical, continuous surface through a revolution of substantially $\frac{3}{4}$ of a circle, and adapted to cradle and hold captive a section of the bead of the container lid.

8. The invention as defined in claim 1, wherein:

(a) said jaws are integral with one another and with said hinge, (b) said jaws and hinge defining a channel having a mouth, (c) the mouth of said channel being narrower than other portions thereof.

9. The invention as defined in claim 1, wherein:

(a) one of said jaws has an undercut configuration, for engagement with a rounded exterior surface of the lid bead.

10. The invention as defined in claim 1, and further including:

(a) means on the body for enabling it to be secured to the side of the trash container.

11. The invention as defined in claim 1, wherein:

(a) said hinge comprises a strip of spring metal secured to the extremity portion of the body, and to remaining portions of the body.

12. The invention as defined in claim 11, wherein:

(a) said hinge includes means for adjustably positioning one jaw a greater or lesser distance from the other, in order to accomodate container lid beads of various sizes.

13. The invention as defined in claim 11, wherein:

(a) said body has a longitudinal slot, (b) the extremity portion of said body having an additional slot substantially aligned with the first slot, (c) said spring metal strip being received in said aligned slots, (d) the opposite longitudinal edges of said strip engaging the opposite wall portions of said slot, said wall portions providing a guide for said strip and preventing the latter from canting with respect to the said remaining portions thereof.

14. The invention as defined in claim 1, wherein:

(a) said hinge comprises a strip of spring metal, (b) said strip having an elongate adjustment slot, (c) a screw extending through said slot and anchored to the body, to thereby permit adjustment of the position of the extremity portion and one jaw with respect to remaining portions of the body and the other jaw.

15. The invention as defined in claim 13, wherein:

(a) said body has a shallow recess, (b) said strip being disposed in said recess so as to present a substantially continuous flush surface at one side of the clasp device.

16. The invention as defined in claim 1, wherein:

(a) said extremity portion is movable with respect to other parts of the body between a first, bead-retaining position, and a second, bead-releasing position, (b) said hinge and jaws, when the extremity portion is in said first position, forming a channel whose mouth is narrower than other remaining portions thereof, whereby the jaws can lock around the said container lid bead, (c) said channel mouth becoming sufficiently wide so as to enable the bead to be released when the extremity portion is moved to said second position, thereby permitting the container lid to be removed.

17. The invention as defined in claim 1, wherein:

(a) said extremity portion is movable with respect to other parts of the body between a first, bead-retaining position, and a second, bead-releasing position, (b) said hinge and jaws forming a channel whose mouth is narrower than other portions thereof, (c) said hinge including an adjustment means whereby the spacing between said jaws can be varied, to thereby accommodate container lid beads of varying size and enabling the said jaws to snugly fit around said beads when the extremity portion is in said first, bead-retaining position.

18. A trash container having a releasable lid clasp device, arranged for engagement with the bead of the container lid to secure the latter against accidental dislodgment, comprising in combination:

(a) a container body having an open top, (b) a lid mounted on the top of the container body and having a depending flange provided with a strengthened bottom rim, (c) a clasp device comprising a resilient plastic arm carried vertically by the container body, (d) said arm being rigidly attached at its lower end to said body and extending upwardly past the bottom rim of said lid, (e) means on said clasp arm, engageable with the bottom rim for yieldably holding the lid captive on the container body, (f) said resilient arm being bowed by virtue of its engagement with the lid and exerting continuing radially inward pressure on the bottom rim thereof.

* * * * *